United States Patent [19]

Crosser

[11] 4,240,334

[45] Dec. 23, 1980

[54] MECHANICALLY LOCKABLE HYDRAULIC CYLINDER JACK

[75] Inventor: Jeffrey A. Crosser, Hampton, Iowa

[73] Assignee: United Hydraulics Corporation, Hampton, Iowa

[21] Appl. No.: 865,029

[22] Filed: Dec. 28, 1977

[51] Int. Cl.[3] ..... F15B 15/26

[52] U.S. Cl. ..... 92/23; 92/17; 92/33; 92/114

[58] Field of Search ..... 92/13.4, 13.41, 17, 92/23, 33, 114, 108, 15; 91/391R; 188/265, 300

[56] References Cited

U.S. PATENT DOCUMENTS

| | | | |
|---|---|---|---|
| 2,730,994 | 1/1956 | Light | 92/17 |
| 2,934,319 | 4/1960 | Wahlstrom | 91/391 R |
| 3,003,470 | 10/1961 | Geyer | 92/17 |
| 3,092,082 | 6/1963 | Geyer | 92/33 |
| 3,702,181 | 11/1972 | Keller, Jr. | 92/17 |

*Primary Examiner*—Abraham Hershkovitz

*Attorney, Agent, or Firm*—Richard A. Craig; S. Michael Bender

[57] ABSTRACT

Disclosed herein is a hydraulic jack comprising a cylinder and a piston rod assembly which is movable between a retracted position and an extended position relative to the cylinder. The jack also has mechanical locking means including a rotatable shaft and movable into engagement with the piston rod assembly in response to rotation of the shaft, thereby to lock the piston rod assembly in its extended position. The locking means reinforces the piston rod assembly in its extended position along substantially the entire length of the piston rod assembly.

8 Claims, 5 Drawing Figures

MECHANICALLY LOCKABLE HYDRAULIC CYLINDER JACK

The present invention relates generally to hydraulic jacks in the form of a cylinder having an extendable piston rod (hereinafter sometimes referred to as a "hydraulic cylinder jack"), and more particularly, to a hydraulic cylinder jack including additional means for mechanically locking the cylinder'piston rod when the latter is in an extended position.

In U.S. Pat. No. 3,702,181 to Joseph H. Keller, Jr. et al. (hereinafter called "the Keller et al. patent"), there is described a hydraulic cylinder jack for supporting mobile cranes in a stabilized position on relatively rough terrain, and for relieving the vehicle or crane chassis from heavy loads being transmitted thereto when such heavy loads are being lifted by the crane during operation thereof. As an added safety feature in the case of failure of a hose, valve or other hydraulic mechanism, the Keller hydraulic cylinder jack includes a mechanical locking assembly for maintaining the piston rod of the jack in an extended position independent of hydraulic forces. This locking assembly comprises a shaft journaled in the cylinder end wall opposite the end of the cylinder housing through which the piston rod is extendable. The shaft includes a pair of grooves for slidably receiving a pair of keys carried by a threaded sleeve which, in turn, is threadably engaged by a female or internally threaded collar fixedly supported at the upper end of the piston rod. A handle is secured to the other end of the shaft to facilitate rotation thereof whereupon the shaft which is keyed to the threaded sleeve causes the latter to be axially advanced through the female threaded collar until its longitudinal extremity abuts the end of the cylinder casing remote from the piston rod and through which the shaft is journaled. When the threaded sleeve is in this position, bearing loads are transmitted through the piston rod, the female threaded collar affixed to the rod, the threaded sleeve, and the cylinder end wall through which the rod is journaled, thereby directly mechanically locking the piston in its extended position relative to the cylinder casing.

While such locking means may effectively function as a safety device preventing retraction of the piston rod back into the cylinder housing in the event hydraulic pressure is relieved or in the event of a hose or valve or other hydraulic failure, the hydraulic cylinder jack is still susceptible to buckling failure of the piston rod when the latter is in its extended position.

Against the foregoing background, it is a principal object of the present invention to provide a hydraulic cylinder jack including a mechanical locking assembly whose constitutent parts are so arranged as to support or reinforce substantially the entire length of the extended piston rod.

It is a further object of the present invention to provide a hydraulic cylinder jack having a mechanical locking assembly which is an improvement over that described in the Keller et al. patent.

Toward the accomplishment of the foregoing objects and advantages, there is provided a hydraulic cylinder jack having a piston rod assembly mounted therein for movement between a first retracted position and a second extended position. Journaled through the upper end of the cylinder housing remote from the piston rod assembly is a manually rotatable threaded shaft which enters into the piston rod. The threaded shaft is hollow to receive therein one end of a hexagonally-shaped guide pin the other end of which is fixedly secured to the foot or rod end of the piston rod assembly. A locking cylinder having an internally threaded collar at its upper end and a bushing at its lower end is concentrically disposed within the piston rod about the threaded shaft with the latter in threaded engagement with the collar, and with the bushing being entrained upon the guide pin. Rotation of the threaded shaft causes axial threaded advancement of the locking cylinder relative to the threaded shaft whereupon the locking cylinder is prevented from rotating relative to the guide pin by the action of the bushing being entrained on the guide pin; hence, the locking cylinder will advance until the bottom end thereof comes into abutting contact or engagement with the foot or rod end of the piston rod assembly thus establishing a direct connection between the rod, the locking cylinder, the threaded shaft, and the upper case end of the cylinder housing. When so engaged, the locking cylinder in addition to fulfilling its primary function of mechanically locking the piston rod assembly relative to the cylinder casing, furthermore functions to support or reinforce the piston rod assembly throughout substantially the latter's entire length whether partially or fully extended thus serving as a back-up or redundant piston rod. Hence, the hydraulic cylinder jack is reinforced against buckling or collapse even when unexpected heavy loading results in buckling failure of the main piston rod component.

The foregoing and still other objects and advantages of the present invention will be made more apparent from a study of the following detailed description of the preferred form of the invention in connection with the accompanying drawings wherein.

Figure 1:
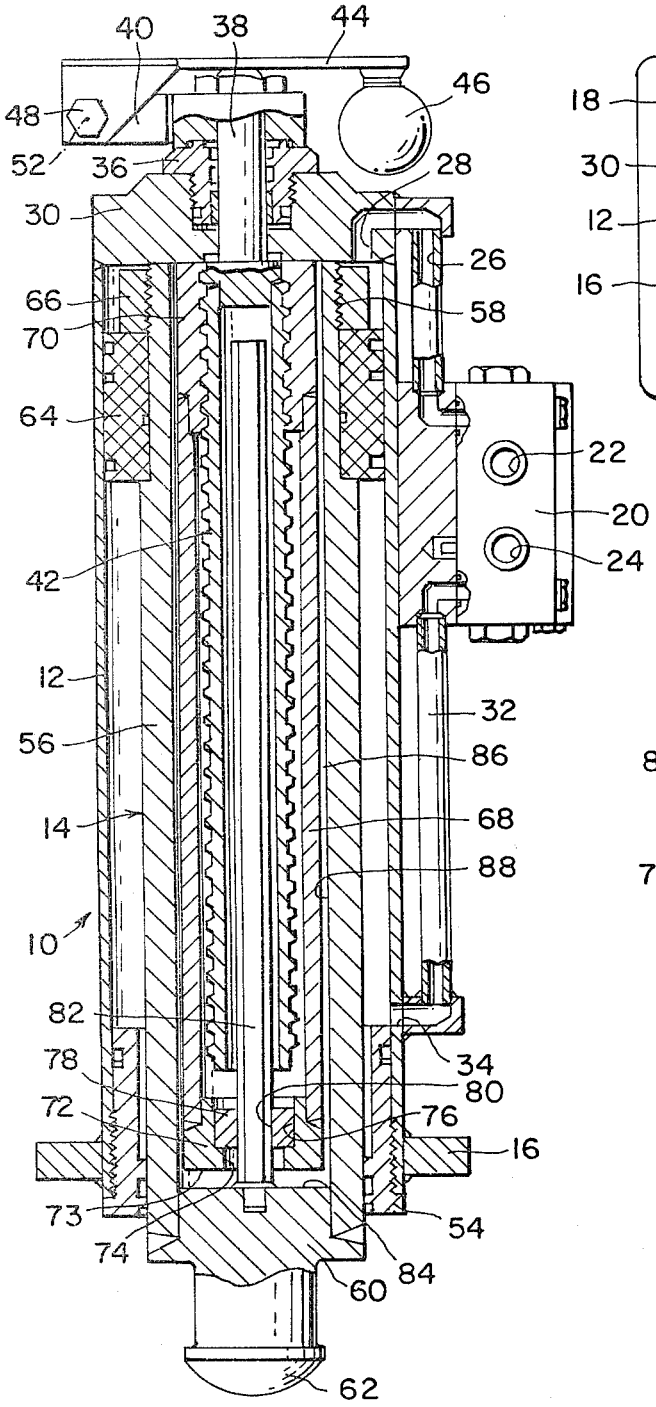
FIG. 1 is a sectional view in elevation of the hydraulic cylinder jack of the present invention with the piston rod assembly being shown in the retracted position.
Figure 2:
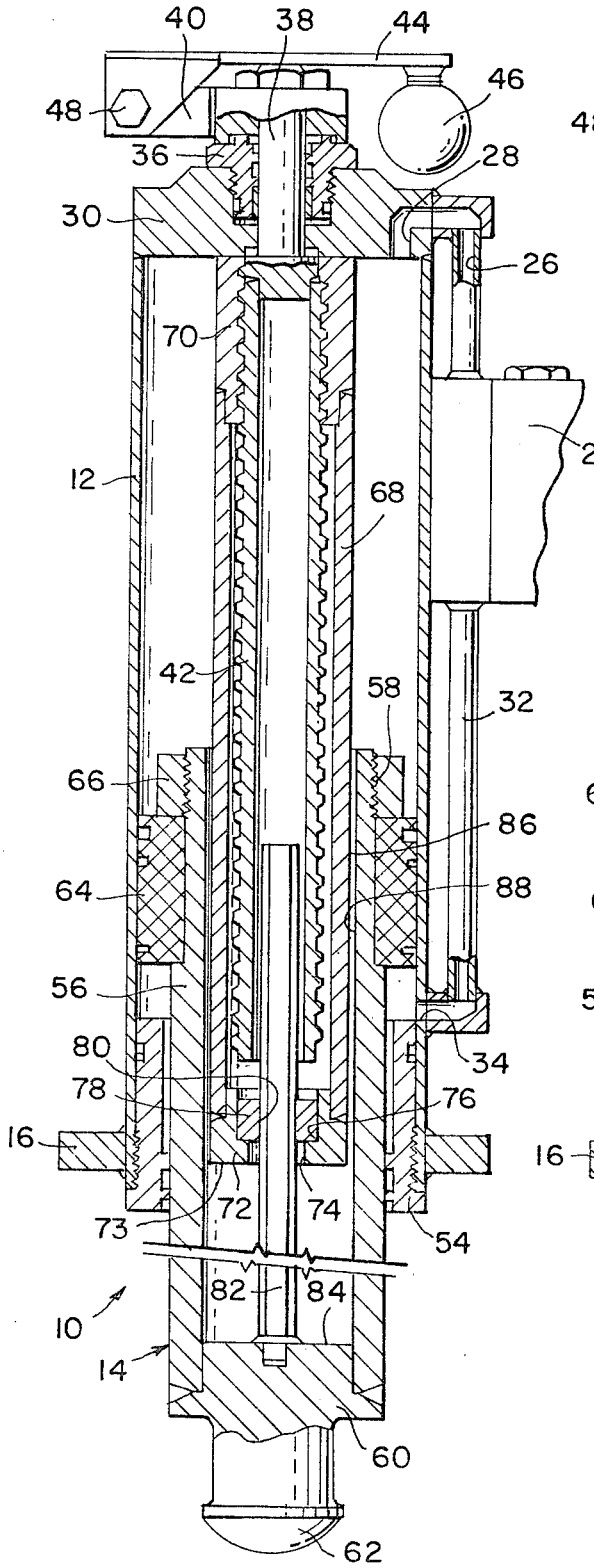
FIG. 2 is a sectional view in elevation of the hydraulic cylinder jack of the present invention showing the piston rod assembly in the extended position.
Figure 3:
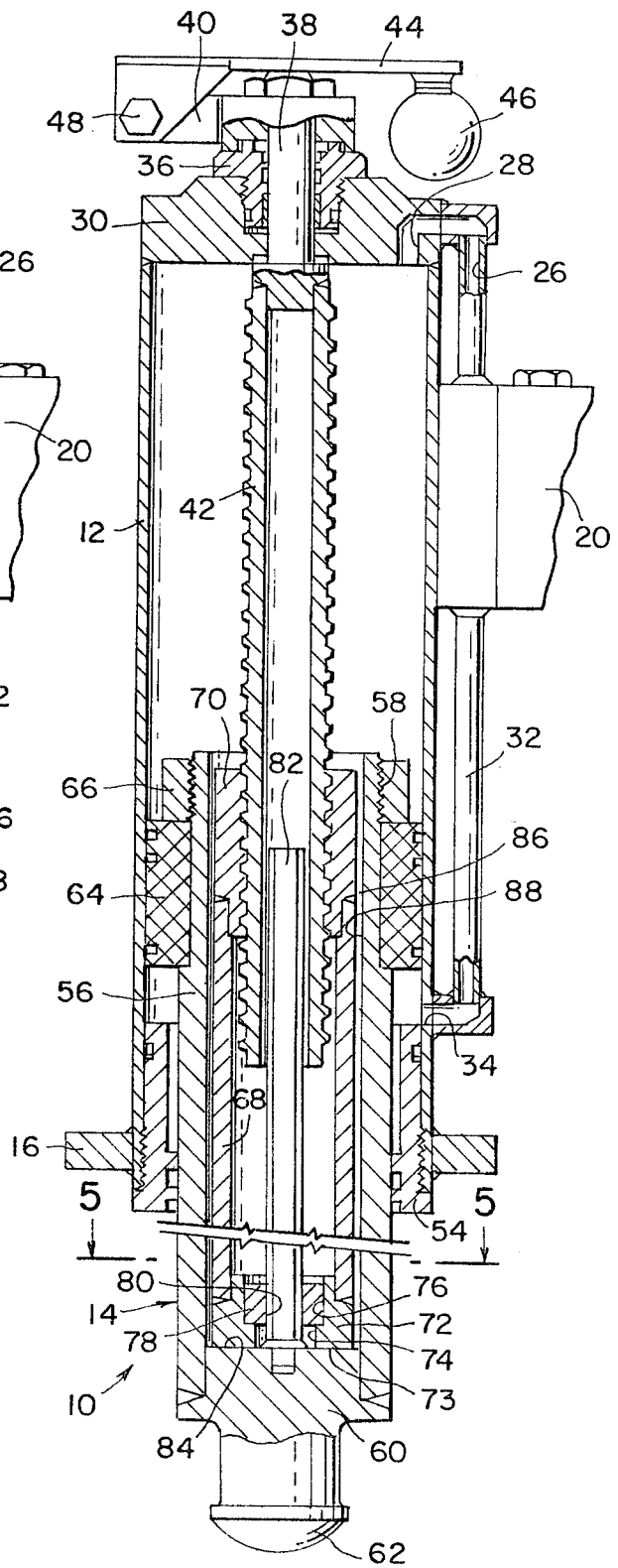
FIG. 3 is a sectional view in elevation of the hydraulic cylinder jack of the present invention showing the piston rod assembly and the locking cylinder in the extended or locking position.

With reference to FIGS. 1 through 5, the hydraulic cylinder jack of the present invention is generally designated by reference numeral 10 and comprises a cylindrically-shaped housing or casing 12 having a substantially cylindrically-shaped piston rod assembly 14 mounted for slidable movement within the casing between a first retracted position (FIG. 1) and a second extended position (FIGS. 2 and 3). Fixedly secured to the casing near the bottom extremity thereof as by welding, for example, is a mounting flange 16 having a plurality of through holes 18 for facilitating the mounting of the hydraulic cylinder to the outrigger frame of a mobile crane or other load transmitting member (not shown). The cylinder casing further includes fixedly attached thereto a hydraulic manifold block 20 having an inlet port 22 and an outlet or exhaust port 24 for connectably receiving in a conventional manner hydraulic conduits carrying a hydraulic working fluid under pressure.

The manifold block supplies the hydraulic working fluid to an input conduit 26 which feeds an inlet port 28 located in the upper end wall 30 of casing 12 whereas exhaust port 24 is connected to a conduit 32 which, in turn, is connected to an exhaust port 34 located in the wall of the casing 12 near the lower extremity thereof spaced slightly upward from mounting flange 16 as substantially shown. The upper end wall 30 is sealingly connected to the casing 12 in a conventional manner, preferably by welding.

Figure 4:
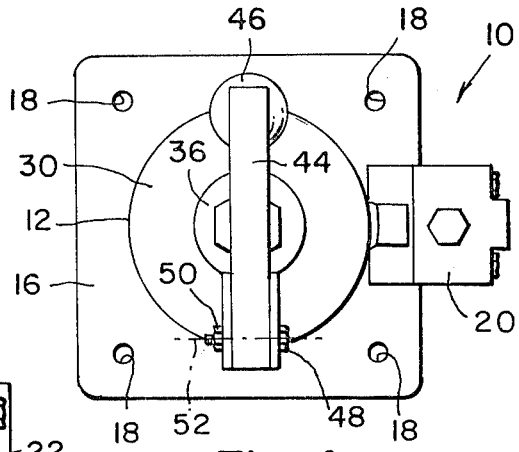
FIG. 4 is a top view of the hydraulic cylinder jack of the present invention.
Figure 5:
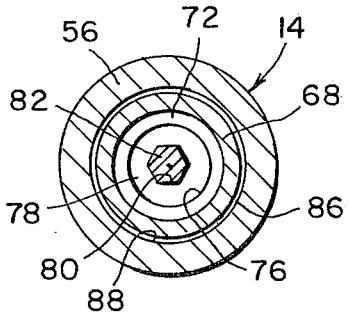
FIG. 5 is a transverse cross-sectional view of the hydraulic cylinder jack of the present invention taken along line 5–5 of FIG. 3.

Centrally mounted in the casing upper end wall 30 is a journal element 36 for rotatably supporting a shaft 38 having a crank 40 suitably connected at its upper end, and a hollow, externally threaded portion 42 extending longitudinally into the casing toward the lower extremity thereof. A foldable extension 44 including a ball-shaped handle portion 46 is attached to crank 40 by means of threaded bolt fastener 48 and nut 50 (FIG. 4). By loosening nut 50, extension 44 may be rotated 180° about pivot axis 52 to increase the length of the crank and thereby facilitate manual rotation of shaft 38 within journal 36 and relative to casing 12.

Fixedly secured within the bottom end of casing 12 is a conventional bushing or gland 54 which seals the casing and serves as a guide means for movement of the piston rod assembly into and out of the casing between the assembly's retracted and extended positions.

The piston rod assembly includes a cylindrical body member 56 having an externally threaded portion 58 proximal to its open upper end, and further includes a bottom end portion 60 which preferably is welded in place to sealingly close off the bottom end of the cylindrical body member substantially as shown. The distal extremity of bottom end portion 60 is in the form of a hemispherically shaped ball joint member 62 for engaging a conventional complementary foot pad such as that shown and described in the Keller et al. patent, which is hereby incorporated herein by this reference. As is well known in practice, the ball joint member 62 and its complementary foot pad help to distribute loads transmitted through the hydraulic cylinder jack to a ground support surface, and further, serves to adjust for any misalignment between the cylinder and the ground as may be necessary, for example, in rough terrain.

A piston 64 is fixedly secured near the upper end of the cylindrical body member 56 by means of an internally threaded fastener or nut 66 which engages the complementary threaded portion 58 of the cylindrical body member. The piston 64 includes conventional sealing rings peripherally supported therein for engagement with the internal surface of the casing so as to avoid leakage of hydraulic oil between the upper and lower faces of the piston and vice versa.

Disposed interiorly of casing 12 in a concentric manner between the cylindrical body member 56 of the piston rod assembly and the threaded portion 42 of shaft 38 is a locking cylinder 68 fixedly connected as by welding at its upper end to a collar 70 which latter threadedly engages the threaded portion 42 of shaft 38 substantially as shown. Fixedly secured to the bottom extremity of the locking cylinder, also preferably by welding, is an annular bearing member 72 having a through aperture 74 which, in turn, includes a counterbored portion 76 in which latter is fixedly secured in a concentric manner a bushing 78 fabricated from a suitable material such as bronze, for example. Bushing 78 has a hexagonally shaped recess 80 therethrough which slidingly receives a hexagonally shaped guide pin 82 the lower end of which is fixedly secured in a suitable manner within the upwardly facing surface 84 of the bottom end portion 60 of the piston rod assembly and which extends longitudinally upwardly toward the upper end wall 30 of casing 12 within the hollow bore of the threaded portion 42 of shaft 38 as substantially shown in FIG. 1.

It will be appreciated that by virtue of the hexagonal cross-sectional shape of guide pin 82 and the complementary hexagonal shape of the through recess 80 of bushing 78, the locking cylinder 68 is caused to displace axially relative to the common central axis of guide pin 82 and casing 12 in response to rotation of shaft 38 and consequent rotational engagement of the threaded portion 42 of shaft 38 with the complementary threaded collar 70 i.e., the hexagonally shaped bushing 78 and the hexagonally shaped guide pin 82 mutually cooperate to prevent rotation of the locking cylinder 68 relative to the guide pin. Instead, shaft 38 and its threaded portion 42 rotates relative to collar 70 and the locking cylinder thus causing the collar 70 and the locking cylinder integral therewith to threadedly advance longitudinally along threaded portion 42 as will occur to those skilled in the art.

In order to facilitate the axial or longitudinal displacement of the locking cylinder relative to the guide pin 82 and/or within the hollow bore of the piston rod assembly, an annular clearance space 86 is provided between the external peripheral surface of locking cylinder 68 and the internal bore surface 88 of cylindrical body member 56 sufficient to permit the flow of hydraulic working fluid therethrough during such axial displacement of the locking cylinder.

In the use of the hydraulic cylinder jack of the present invention, the piston rod assembly 14 is caused to move from its retracted position as shown in FIG. 1 to its extended position as shown in FIG. 2 by causing hydraulic working fluid under pressure to be admitted through manifold block inlet 22, conduit 26, and inlet port 28 into the upper portion of the casing interior whereupon the hydraulic fluid acting against the upper face of piston 64 causes axial movement of the cylinder body 56 all of the while hydraulic fluid on the side of the piston's bottom face is allowed to escape through exhaust port 34, conduit 32 and manifold outlet 24.

At this stage, the piston rod assembly is in the extended position shown in FIG. 2 with the locking cylinder in its upward or rest position. The threaded nut 50 may then be loosened to permit the crank handle extension 44 to be pivoted into its unfolded position whereupon manual rotation of shaft 38 may be effected by rotation of the crank 40. Such rotation causes the threaded portion 42 of the shaft to rotate which, in turn, causes collar 70 and the locking cylinder 68 to advance axially until the bottom surface 73 of bottom bearing member 72 comes into abutting engagement with the upper surface 84 of the piston rod assembly bottom end portion 60. The load acting on the piston rod assembly will prevent rotation of same. At this point there will exist a direct mechanical connection between the bottom end portion 60 of the piston rod assembly, the bottom bearing member 72 of the locking cylinder, the walls of the locking cylinder 68, the collar 70, the threaded portion of shaft 38, the shaft 38, the upper end wall 30 of the casing, the casing itself, the mounting flange 16 and the outrigger frame of the crane or other mobile vehicle to which the hydraulic cylinder jack is attached. The pivotal crank extension 44 may then be folded it into its initial or rest condition and the fastener 48 and nut 50 retightened whereupon the hydraulic cylinder jack will be disposed substantially as shown in FIG. 3. In view of the direct mechanical locking action effected by disposition of the locking cylinder into the position shown in FIG. 3, the hydraulic fluid pressure on the upper side of the piston 64 of the piston rod assembly may be relieved or may be maintained to supplement the action of the direct mechanical linkage produced by the locking cylinder depending upon the individual requirements of the user.

In any event, it will be appreciated that as a result of the novel locking means of the hydraulic cylinder jack of the present invention wherein the locking cylinder is disposed concentrically within the piston rod assembly to effect a direct mechanical linkage extending between the bottom end portion of the piston rod assembly and the casing of the cylinder as described above, the piston rod assembly of the hydraulic cylinder jack is supported and/or reinforced along substantially its entire extended length. Thus, in the event of buckling failure of the main piston rod component of the jack, the locking cylinder serves as a back-up or redundant piston rod preventing collapse of the hydraulic cylinder jack. This is in direct contrast to the prior art hydraulic cylinder jack locking means as exemplified by the Keller et al. patent, for example, wherein the locking means effects a direct mechanical connection between the upper end of the piston rod assembly and the cylinder casing, and which accordingly, is relatively more susceptible to buckling failure of the piston rod assembly when the latter is in its extended position.

Thus, in view of the foregoing, it should now be apparent that the present invention relates to a greatly improved hydraulic cylinder jack having mechanical locking means associated therewith. Furthermore, it will be appreciated that many variations may be made without departing from the spirit and principles of the invention. For example, while it is intended that the hydraulic cylinder jack may advantageously be employed in connection with a mobile crane as shown in FIGS. 1 through 4 of the Keller et al. patent, the hydraulic cylinder jack of the present invention may also be employed in a suitable manner with other types of vehicles or installations requiring such a device, and therefore, the invention should be limited only by the true scope of the claims appended hereto.

I claim:

1. In a hydraulic jack comprising a cylinder and a piston rod assembly movable between a first retracted position and a second extended position relative to said cylinder, means for preventing rotation of the piston rod assembly, means for maintaining said piston rod assembly locked in said second extended position comprising a rotatable shaft extending into said cylinder, locking means operatively coupled to said shaft and movable into engagement with said piston rod assembly in response to rotation of said shaft to thereby lock said piston rod assembly in its second extended position, said locking means being adapted to reinforce said piston rod assembly in said second extended position substantially along said piston rod assembly's entire length, said cylinder including a first closed end and a second open end through which said piston rod assembly is movable, and said locking means is movable into engagement with at least a portion of said piston rod assembly located beyond the second open end of said cylinder when said piston rod assembly is in said second extended position, said shaft extending through the first closed end of said cylinder and wherein a portion of the shaft extending into said cylinder has thread means thereon and said locking means comprises a second cylinder concentrically disposed between said shaft and said first-mentioned cylinder, said second cylinder including thread means for cooperatively engaging the thread means on said shaft to lock the piston rod assembly in its extended position. The locking means reinforces the piston rod assembly in its extended position along substantially the entire length of the piston rod assembly.

2. The invention of claim 1 wherein said piston rod assembly comprises a hollow cylindrical body member having a first open end and a second closed end and said locking means is movable through said first open end into engagement with said second closed end.

3. The invention of claim 1 wherein said piston rod assembly includes a guide pin fixedly secured thereto and extending axially of said first and second cylinders, and said second cylinder includes a bushing fixedly secured thereto and receivably engaging said guide pin.

4. The invention of claim 3 further including means for preventing rotation of said second cylinder relative to said guide pin during movement of said second cylinder into engagement with said at least portion of said piston rod assembly.

5. The invention of claim 4 wherein said second cylinder rotation prevention means comprises said guide pin having a hexagonally-shaped transverse cross-section and said bushing having a complementary shaped recess extending axially therethrough.

6. The invention of claim 3 wherein at least said threaded portion of said shaft is hollow and has an open end at its distal extremity for axially receiving said guide pin.

7. The invention of claim 3 wherein said bushing is secured to the end of said second cylinder which engages said piston rod assembly.

8. The invention of claim 1 wherein said cylinder includes a mounting flange fixedly attached thereon near said second open end.

* * * * *